US005205222A

United States Patent [19]

Bernard

[11] Patent Number: 5,205,222

[45] Date of Patent: Apr. 27, 1993

[54] COUNTER ATTACHABLE IRONING BOARD

[76] Inventor: Ronald V. Bernard, P.O. Box 2588, Florence, Oreg. 97439

[21] Appl. No.: 893,571

[22] Filed: Jun. 4, 1992

[51] Int. Cl.[5] ..... A47B 57/00

[52] U.S. Cl. ..... 108/97; 108/42

[58] Field of Search ..... 108/97, 42, 47, 48, 108/152; 38/103

[56] References Cited

U.S. PATENT DOCUMENTS

| | | | |
|---|---|---|---|
| 922,487 | 5/1909 | Knorr | 108/97 |
| 956,705 | 5/1910 | Hofacker | 108/97 |
| 1,535,271 | 5/1925 | Schackmann | 108/97 |
| 1,977,431 | 10/1934 | Des Isles | 108/97 |
| 2,014,549 | 9/1935 | Behm | 108/48 X |
| 2,028,789 | 1/1936 | Lundquist | 108/97 X |
| 2,512,958 | 6/1950 | Meier | 108/97 |
| 2,709,563 | 5/1955 | Starkey | 108/97 |
| 4,314,685 | 2/1982 | Schwan | 108/107 X |
| 4,480,556 | 11/1984 | Wilson et al. | 108/48 |

*Primary Examiner*—Jose V. Chen

*Attorney, Agent, or Firm*—James D. Givnan, Jr.

[57] ABSTRACT

An ironing board for counter or table top attachment including an elongate main member for receiving the article being ironed. A pair of arms carry a disk which is beveled about its perimeter for wedged engagement with a pair of undercut rails affixed to the underside of the elongate main member to permit positioning of the elongate main member to best suit the user. A clamping arm is carried by the pair of arms and is upwardly engageable with the lip or overhang of the counter or table top. A handwheel and shaft permit upward urging of the clamping arm. A modified form of the present ironing board utilizes a clamping arm having a free end segment of reduced width to permit clamped engagement with a counter top between adjacent drawers below the counter.

3 Claims, 1 Drawing Sheet

COUNTER ATTACHABLE IRONING BOARD

BACKGROUND OF THE INVENTION

The present invention concerns ironing boards of the type for temporary placement on a table or counter top.

Conventional ironing boards are of a size to hamper their use and storage in small living units such as recreational vehicles, mobile homes, small apartments and the like. In the prior art are ironing boards adapted for temporary securement to tables and typically utilize a C-clamp type coupling for table edge attachment. Samples of such ironing boards are found in U.S. Pat. Nos. 1,190,113; 2,028,789; and 2,263,058.

A studier and much more stable support for an ironing board would be the edge of a kitchen counter; however, known clamping arrangements for periodically used ironing boards are not attachable to such counter tops by reason of the restricted surface area, i.e., that portion of a counter projecting outwardly from a subjacent cabinet wall. Typically such a counter overhang surface is from one quarter to three quarters of an inch. A further problem is that the outer faces of kitchen cabinet drawers restrict the unencumbered area of a cabinet wall against which a clamp may abut when mounted in place.

An additional problem not remedied by known temporarily installed ironing boards is the failure to provide for selective positioning of the ironing board itself relative the counter or table edge. Accordingly, the user is unable to position the board to best suit the user's preference and/or avoid conflict with walls or items in place on a counter top.

SUMMARY OF THE PRESENT INVENTION

The present invention is embodied in a clamping arrangement for attachment of an ironing board to the projecting edge of a kitchen counter or table top with provision made for enabling the positioning of the ironing board proper relative the counter or table top.

The ironing board itself is supported spaced above a counter or table top surface to facilitate positioning of the article being ironed. A clamp assembly includes a swingably mounted arm which upwardly engages the lower surface of a counter or table overhang. The arm has an upright surface at its distal end for abutment with a cabinet or table face and when so in place inhibits any tendency of the ironing board structure to tip or rock about the counter edge. A handwheel of the clamp assembly permits secure attachment of the ironing board regardless of the limited edge surface area for clamp attachment. A preferred form of the present ironing board includes undercut rails which cooperate with a beveled disk to permit coupling of the board to the support structure throughout a wide range of angularly offset positions to best suit the user and space restrictions.

Important objectives of the present ironing board include the provision of an ironing board for secure attachment to a counter or table edge regardless of limited surface area available to receive a clamp; the provision of an ironing board with the ironing board proper positionable about a vertical axis; the provision of an ironing board readily installed on a counter or table top positioned for various ironing tasks and stored in a compact manner to render same highly practical to those living in recreational vehicles, mobile homes, small apartments and the like.

BRIEF DESCRIPTION OF THE DRAWINGS

In the accompanying drawings.

DETAILED DESCRIPTION OF THE PREFERRED EMBODIMENTS

Figures 1, 2, 3, 4, 5:
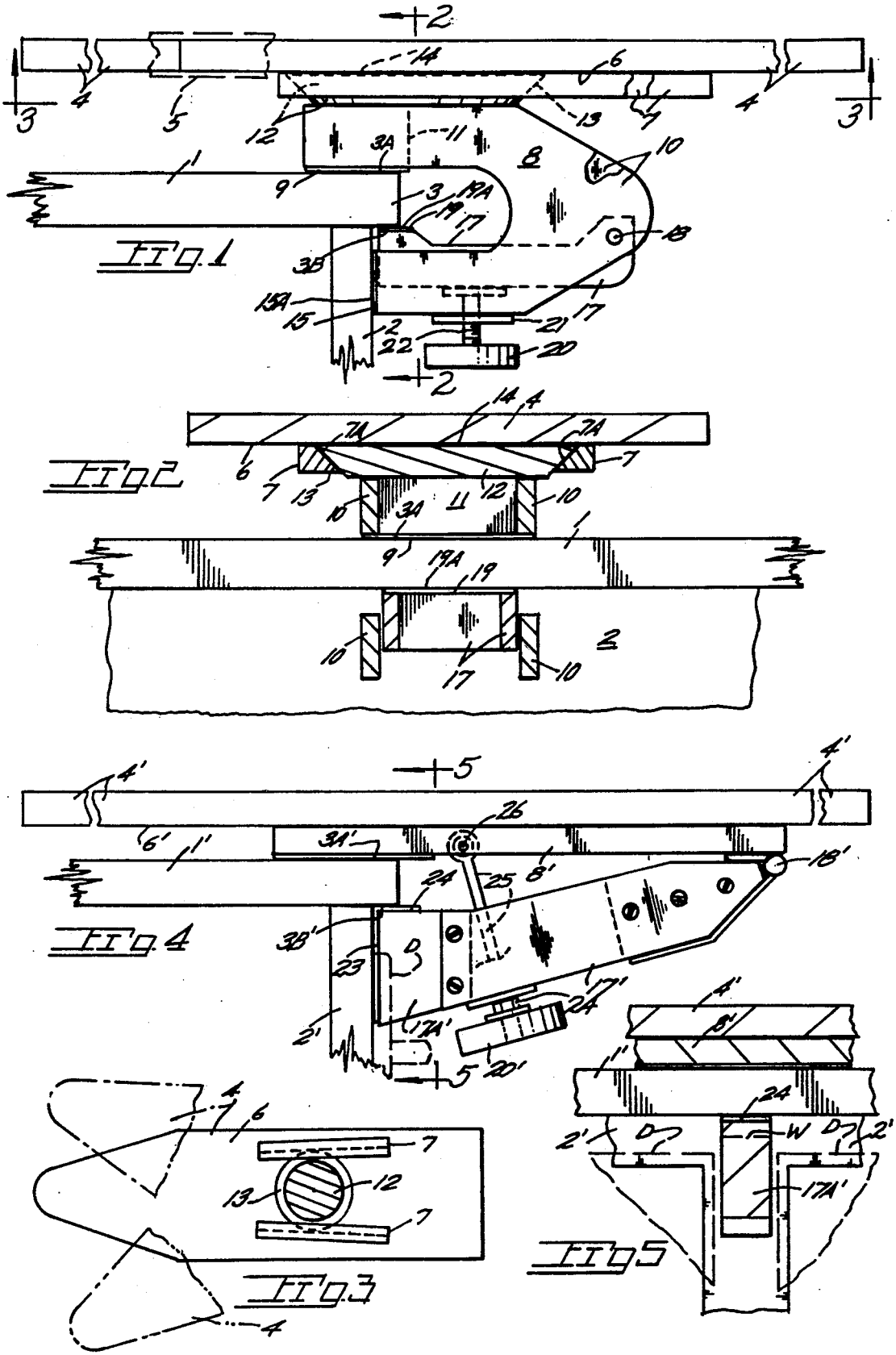
FIG. 1 is a side elevational view of the present ironing board in place on a counter edge.
FIG. 2 is a vertical sectional view taken along line 2—2 of FIG. 1.
FIG. 3 is a horizontal sectional view taken upwardly along line 3—3 of FIG. 1.
FIG. 4 is a view similar to FIG. 1 but showing a modified form of the ironing board.
FIG. 5 is a vertical sectional view taken along line 5—5 of FIG. 4.

With continuing attention to the drawings, the reference numeral 1 indicates an ironing board support which in the present instance is a kitchen counter top 1 in place on a cabinet face or outer wall 2. An overhang is at 3 and typically projects from one quarter to three quarters of an inch beyond wall 2. Upper and lower overhang surfaces are at 3A and 3B.

An ironing board main member is at 4 which receives a fabric cover 5. The underside 6 of the ironing board receives convergent rails 7 which have their opposed edges undercut to provide upwardly and outwardly extending surfaces 7A relative the lengthwise axis of the board.

Ironing board support means is at 8 and includes a friction enhancing surface at 9 for counter top engagement. In FIG. 1, the support means 1 includes mounting arms 10 with a block 11 secured therebetween. A beveled disk at 12 on the block is beveled at 13 about its circumference for wedged engagement with the convergent, undercut rails 7. The disk upper surface 14 firmly abuts the underside of the ironing board when the disk and rails are in seated engagement.

The mounting arms 10 extend downwardly and then forwardly to terminate in forward ends 15 which are coated with a resilient synthetic compound 15A to protect cabinet wall 2.

A clamp arm at 17 is pivotally mounted at its proximal end by a pivot pin 18 carried by support arms 10. The free end of clamp arm 17 has a generally horizontal surface at 19 also provided with a coating of a resilient, friction enhancing compound 19A to assure non-slip engagement with the limited underside surface area 3B of the counter overhang. A handwheel at 20 carried by a plate 21 on arms 10 permits upward biasing of clamp arm 17 into forceful contact with the counter overhang. Plate 21 is suitably mounted on the arms 10 and has a threaded aperture to receive handwheel shaft 22. As kitchen counter tops are approximately one inch thick the arm surface 19 is positionable so as to effect uniform surfacial engagement with the counter underside at 3B to avoid dislodgement.

A modified form of the present counter attachable ironing board is disclosed in FIGS. 4 and 5 wherein parts corresponding to those parts mentioned above are identified with like prime reference numerals. The modified ironing board includes an ironing board at 4' having a support means 8' affixed to the board underside. Pivotally attached by a pivot 18' shown as a hinge is an arm 17' which terminates at its distal end in an upright edge 23. An adjacent horizontal arm edge is at 24 which edges are orthogonal and provided with a resilient coating to contribute to non-slip engagement with corresponding portions of the counter and cabinet structure. The arm 17' has an end segment 17A' of reduced width at W (FIG. 5) to permit arm engagement with a cabinet face intermediate drawers at D. While arm 17' is shown as being installed so as to project at right angles from the cabinet face, it will be understood that suitable engagement with a table or counter overhang may be achieved with arm 17' in an oblique relationship with the cabinet face.

A clamp assembly includes a handwheel 20' on which is affixed a nut element 24 in threaded engagement with a threaded segment of a shaft 25 swingably carried by a pin 26 which passes through an end eye on shaft 25.

In use, the ironing board shown in FIG. 1 is readily positionable into angularly related positions about disk 12. Coupling of the rails to the disk is effected by lengthwise movement of the ironing board to effect seating of the rails in a wedged manner against the inclined surface of the disk. Tipping of the support arms is prevented by the sizeable surface area 15 of the arm ends which are in abutment with the cabinet face 2. With attention to the modified form of ironing board shown in FIGS. 4 and 5, the reduced width W of arm end segment 17A' enables abutment of arm end surface 23 against a cabinet face intermediate adjacent drawers D. Positioning of the ironing board other than perpendicular to the cabinet may be effected by clamping of the arm 17' to the counter in an oblique manner. If so desired, the support means 8' may be provided with a disk of the type shown at 12 in FIG. 1 to permit additional positioning of the ironing board in relation to the subjacent counter.

While I have shown but a few embodiments of the invention, it will be apparent to those skilled in the art that the invention may be embodied still otherwise without departing from the spirit and scope of the invention.

Having thus described the invention, what is desired to be secured by a Letters Patent is:

I claim:

1. An ironing board for temporary attachment to a counter or table edge portion having an upper surface and a lower surface and a wall surface, said ironing board comprising, an elongate main member for positioning above said edge portion and including spaced apart rail members, support means for superimposed placement on said edge portion and including a disk, said rail members and said disk having engageable inclined surfaces for wedged engagement with one another to permit mounting of the elongate main member on said support means in various angularly offset positions about the center of said disk, a clamp assembly having an arm including a generally horizontal surface adjacent its distal end for upward biased contact with said lower surface, said arm including an upright surface at its distal end, pivot means attaching said arm to said support means, and adjustable means acting on said arm for urging same upwardly into biased contact with said edge portion.

2. The ironing board as claimed in claim 1 wherein said rails are in convergent relationship with one another, said disk having a beveled perimeter for rail engagement.

3. The ironing board claimed in claim 1 wherein said pivot means is embodied in a hinge coupling one end of said arm to said support means, said upright surface of the arm of reduced width relative a major segment of the arm to permit abutment of said upright surface with a cabinet face intermediate cabinet drawers below the counter.

* * * * *